United States Patent [19]

Browning et al.

[11] 4,092,768

[45] June 6, 1978

[54] METHOD FOR MAKING A DIAPHRAGM WITH CAST NOZZLE BLOCKS

[75] Inventors: William W. Browning; Donald J. Legacy, both of Wellsville, N.Y.

[73] Assignee: Turbodyne Corporation (Steam Turbine Division), Wellsville, N.Y.

[21] Appl. No.: 687,923

[22] Filed: May 19, 1976

Related U.S. Application Data

[62] Division of Ser. No. 631,891, Nov. 14, 1975, Pat. No. 4,025,229.

[51] Int. Cl.[2] ..... B23P 15/04

[52] U.S. Cl. ..... 29/156.8 R; 29/418

[58] Field of Search ..... 29/156.8 R, 156.8 B, 29/411, 445, DIG. 5; 415/216, 217, 218, 219 R, DIG. 5; 164/60

[56] References Cited

U.S. PATENT DOCUMENTS

| | | | |
|---|---|---|---|
| 974,956 | 11/1910 | Emden et al. | 415/217 |
| 1,819,485 | 8/1931 | Sedlmeir | 415/217 |
| 1,938,382 | 12/1933 | Haigh | 29/156.8 R |
| 2,013,512 | 9/1935 | Birmann | 415/219 R |
| 2,299,449 | 10/1942 | Allen | 29/156.8 R |
| 2,447,942 | 8/1948 | Imbert et al. | 415/219 R |
| 2,556,890 | 6/1951 | Thorn | 29/156.8 B |
| 2,961,748 | 11/1960 | Been | 29/156.8 R |
| 3,038,699 | 6/1962 | Kaplan | 29/156.8 R |
| 3,260,505 | 7/1966 | VerSnyder | 164/60 |
| 3,650,635 | 3/1972 | Wachtell et al. | 415/115 |
| 3,751,180 | 8/1973 | Cameron | 415/216 |

FOREIGN PATENT DOCUMENTS

| | | | |
|---|---|---|---|
| 628,047 | 2/1963 | Belgium | 415/217 |
| 437,260 | 11/1926 | Germany | 415/217 |

*Primary Examiner*—C.W. Lanham
*Assistant Examiner*—Daniel C. Crane
*Attorney, Agent, or Firm*—Daniel H. Bobis

[57] ABSTRACT

Manufacture of a turbine diaphragm assembly is effected by forming an arcuate V-shaped nozzle block mounting groove on the front side of a generally cylindrical plate so that the respective side surfaces of the V-shaped nozzle block mounting groove has a predetermined slope with respect to the longitudinal axis of the cylindrical plate, investment casting a plurality of individual nozzle blocks each of which includes, a nozzle blade extending in curvilinear fashion between an inner and an outer shroud segment which shroud segment on each nozzle block interfits with the inner and outer shroud segment of each of the other nozzle blocks, the said inner and outer shroud segments being sloped on their outer surfaces to correspond with the slope of the respective inner and outer side surfaces of the V-shaped nozzle block mounting groove so that an arcuate array of said nozzle blocks can be mounted in said V-shaped nozzle block mounting groove in interfitted, side by side relationship in such a manner that the respective exit edges of the respective nozzle blades of said nozzle blocks are substantially radially disposed relative to the longitudinal axis of said cylindrical plate, bonding said inner and outer shroud segments of the respective plurality of nozzle blocks to the respective inner and outer side surfaces of said V-shaped nozzle mounting groove, and removing material from the back face of said cylindrical plate in alignment with said nozzle blade mounting groove so as to open flow passages through said cylindrical plate as defined by the adjacent nozzle blades of the interfitted nozzle blocks.

5 Claims, 22 Drawing Figures

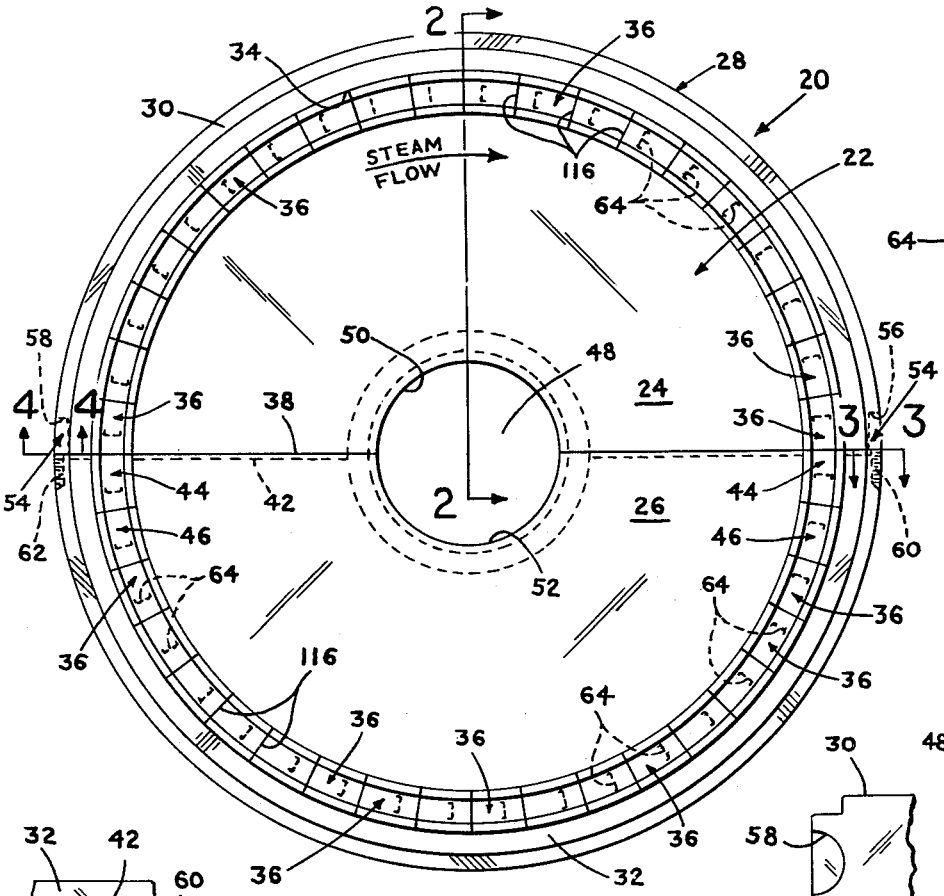
FIG. 1
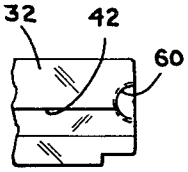
FIG. 3
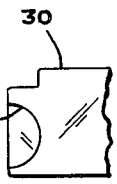
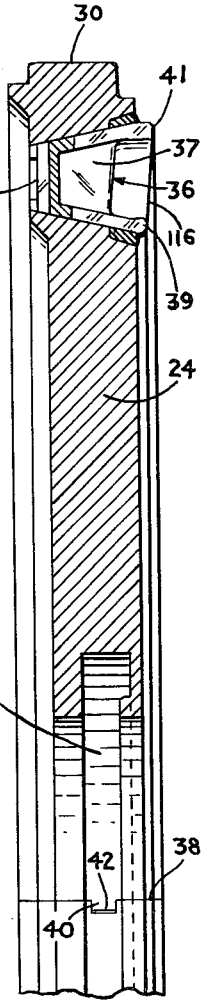
FIG. 4
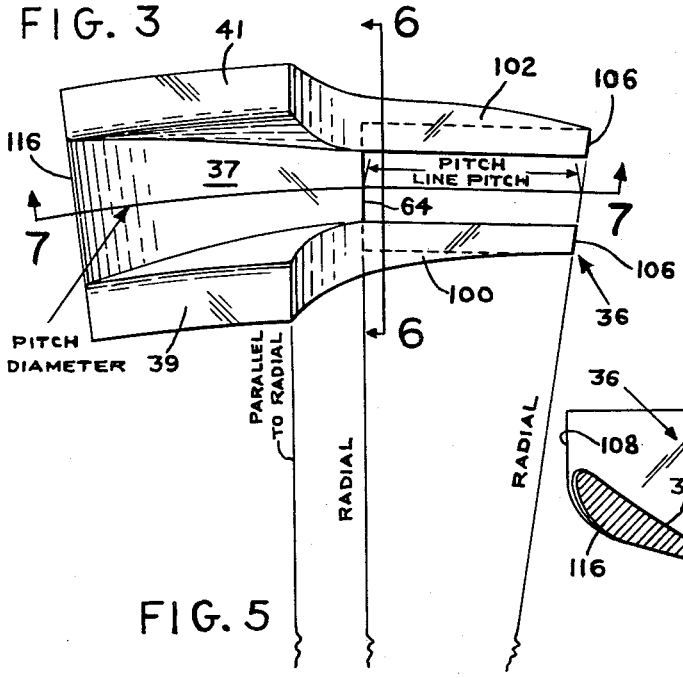
FIG. 5
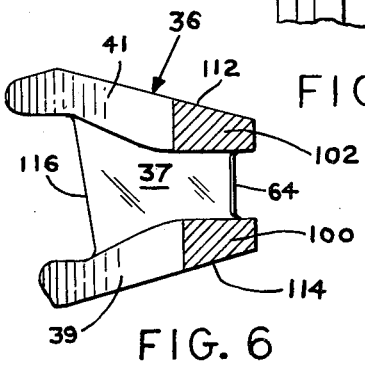
FIG. 6
FIG. 2
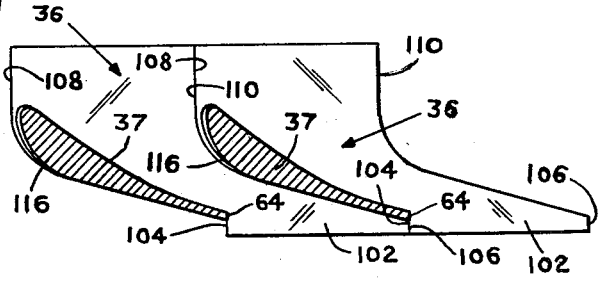
FIG. 7

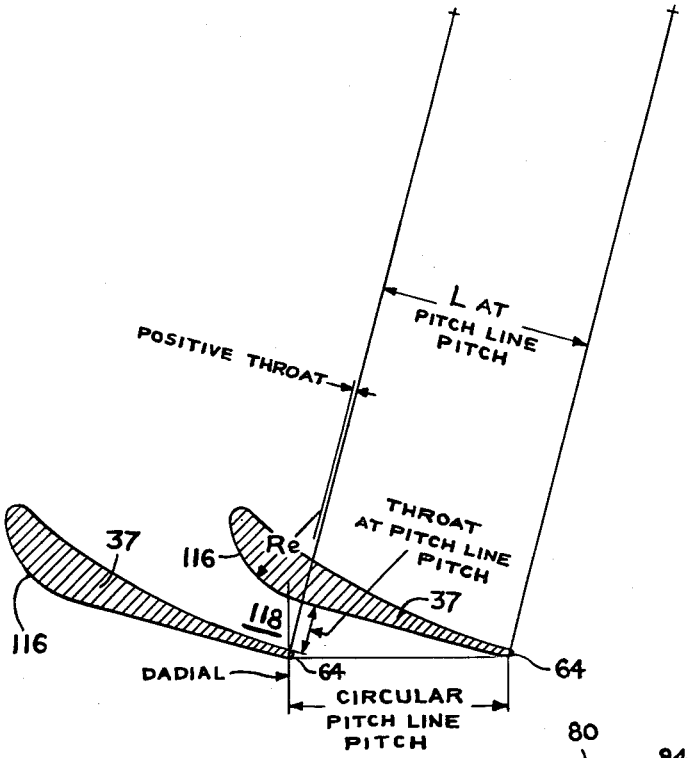
FIG. 8
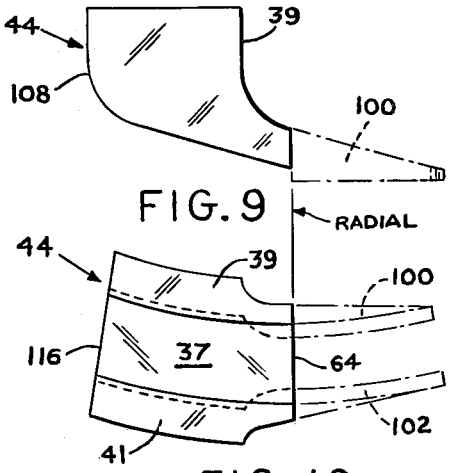
FIG. 9
FIG. 10
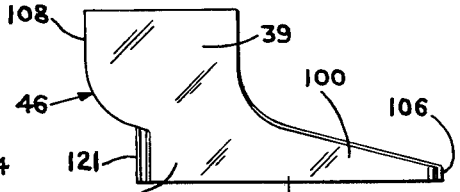
FIG. 11
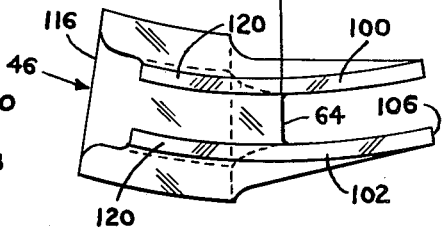
FIG. 12
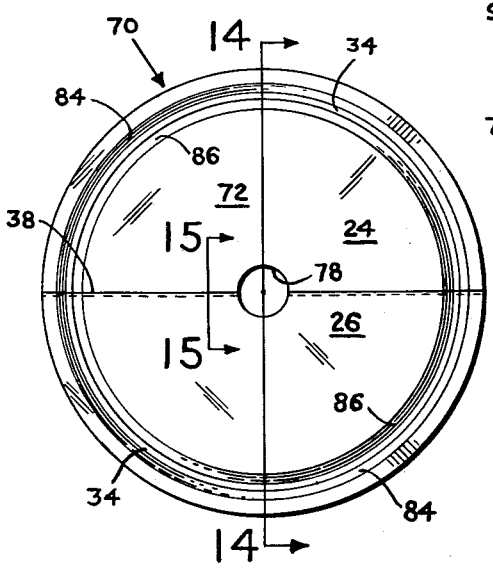
FIG. 13
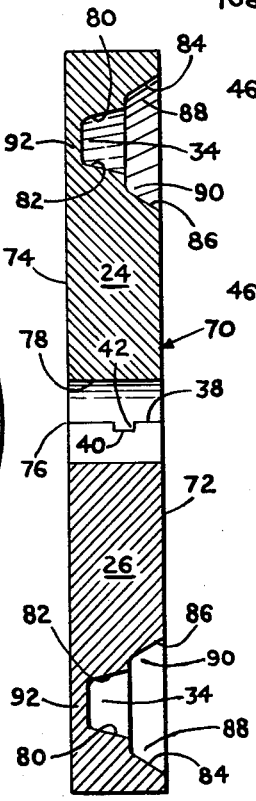
FIG. 14
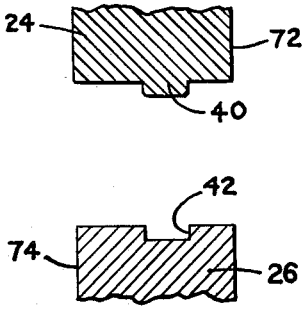
FIG. 15

METHOD FOR MAKING A DIAPHRAGM WITH CAST NOZZLE BLOCKS

This is a division of application Ser. No. 631,891 filed Nov. 14, 1975, now U.S. Pat. No. 4,025,229.

BACKGROUND OF THE INVENTION

1. Field of the Invention

This invention relates to a new and improved turbine diaphragm assembly and method of construction thereof, and to a new and improved nozzle block and method of construction thereof for use in said diaphragm assembly.

2. Description of the Prior Art

Although a wide variety of turbine diaphragm assemblies, and nozzle blocks, and respective methods of construction thereof, are, of course, well known in the prior art, it may be understood that the same will, in many instances, be found to be unduly complicated in requiring the performance of large numbers of relatively complex, time-consuming and costly manufacturing steps, in the nature of precise and difficult machining, with resultant unduly high diaphragm assembly and nozzle block cost. Too, it is believed well known by those skilled in this art that the performance offered by many of the diaphragm assemblies of the prior art is in essence a compromise in that the same are not effective to direct the motive fluid to the adjacent rotor stage at optimum entrance angles throughout the entire radial extent of the included diaphragm nozzle blades with resultant decrease in overall turbine efficiency, and this shortcoming may be understood to be particularly prevalent in those instances wherein extruded nozzle blades are utilized due to well known motive fluid directing performance limitations of the latter.

OBJECTS OF THE INVENTION

It is, accordingly, an object of our invention to provide a new and improved diaphragm assembly, and method of construction thereof, which are respectively less complex and costly than those of the prior art.

Another object of our invention is the provision of a new and improved nozzle block for use in the diaphragm assembly of our invention, and a method of construction thereof, which are respectively less complex and costly than those of the prior art.

Another object of our invention is the method of making an improved turbine diaphragm assembly as above which, because of the configuration of the investment cast nozzle block of our invention, functions to direct the motive fluid to the adjacent rotor stage at optimum entrance angles throughout the entire radial extent of the included diaphragm nozzle blades with resultant maximization of turbine efficiency.

SUMMARY OF THE DISCLOSURE

A new and improved turbine diaphragm assembly is provided and comprises a central hub and a retaining ring spaced from and surrounding the same to provide an arcuate nozzle block mounting passage. The hub and retaining ring are divided by a split along a common diametric plane. An arcuate array of investment cast, single bladed nozzle blocks is disposed in said passage with the respective nozzle block shroud segments interfitting to provide flow passages between adjacent nozzle blades. The exit edges of the nozzle blades are substantially radially disposed relative to the hub, and the flow passages each exhibit a constantly uniform positive throat throughout substantially the entire radial extent thereof to provide for optimum diaphragm performance and maximize turbine efficiency. The diaphragm assembly is constructed by forming an arcuate groove in the front face of a generally cylindrical plate to form a nozzle block mounting groove and leave a web connecting the hub and retaining ring, investment casting the nozzle blocks so that the respective, interfitting shroud segments thereof fit precisely into the mounting groove, firmly and precisely disposing the nozzle blocks in the mounting groove by use of a ring-like fixture which bears against the inlet edges of the nozzle blades and is clamped to the plate, bonding the nozzle blocks in the mounting groove, and removing the web to open the flow passages which are formed between the adjacent nozzle blades. Specialized, transitional nozzle blocks are utilized at each side of the split to traverse the same in part and function to insure precise transverse alignment of the respective hub and retaining ring halves. The investment casting of the nozzle blocks is effective to render the same suitable for immediate disposition in the diaphragm assembly in the complete absence of nozzle block machining.

DESCRIPTION OF THE DRAWINGS

The above and other objects and significant advantages of our invention are believed made clear by the following detailed description thereof taken in conjunction with the accompanying drawings wherein:

FIG. 1 is a front elevational view, taken in the direction of motive fluid flow, of a new and improved diaphragm assembly constructed and operable in accordance with the teachings of our invention;

FIG. 2 is a cross-sectional view taken along line 2—2 in FIG. 1;

FIG. 3 is a cross-sectional view taken along line 3—3 in FIG. 1;

FIG. 4 is a cross-sectional view taken along line 4—4 in FIG. 1;

FIG. 5 is a front face view of a new and improved diaphragm nozzle block constructed and configured in accordance with the teachings of our invention;

FIG. 6 is a cross-sectional view taken generally along line 6—6 in FIG. 5;

FIG. 7 is a cross-sectional view taken generally along arc 7—7 at the circular pitch diameter in FIG. 5, and includes the depiction of an adjacent nozzle block for purposes of illustrating nozzle block interfitting;

FIG. 8 is a typical cross-section taken through the nozzle blades of adjacent nozzle blocks;

FIGS. 9 and 10 are respectively top and front elevational views, with a deleted part shown in phantom for purposes of illustration, of a transitional nozzle block of the invention;

FIGS. 11 and 12 are respectively top and front elevational views of another transitional nozzle block of the invention;

FIG. 13 is a front elevational view of the diaphragm assembly of the invention at an initial stage in the construction thereof;

FIGS. 14 and 15 are respectively cross-sectional views taken along line 14—14 and 15—15 in FIG. 13;

DETAILED DESCRIPTION OF THE INVENTION

1. Structure of the Diaphragm Assembly

Figure 16:
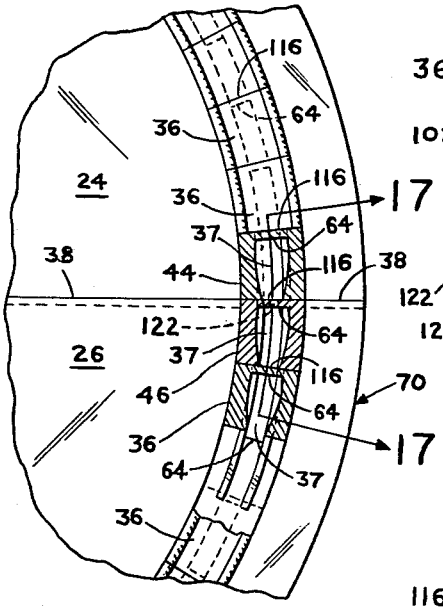
FIG. 16 is a fragmentary front elevational view of the diaphragm assembly at a succeeding stage in the construction thereof; with transitional nozzle blocks broken away.

Referring now to FIGS. 1 and 2, a new and improved diaphragm assembly constructed and operative in accordance with the teachings of our invention is indicated generally at 20 and is for use, for example, in a right hand rotation steam turbine to direct the steam to an adjacent, downstream rotor stage at optimum steam entrance angles throughout the entire radial extent of the diaphragm nozzle blades to thus maximimize turbine efficiency.

The diaphragm assembly 20 is viewed from the front in the direction of steam flow in FIG. 1 and comprises a generally cylindrical central portion or hub 22 which is formed as shown by mated upper and lower halves 24 and 26, and a spaced, concentric nozzle block retaining ring 28 which is formed as shown by mated, upper and lower retaining ring halves 30 and 32, and which surround the hub 22 to provide an annular generally V-shaped nozzle block mounting groove 34 therebetween.

An arcuate array of interfitting nozzle blocks 36, each of which comprises a single nozzle blade 37 which extends between an arcuate inner shroud segment 39 and an arcuate outer shroud segment 41, and each of which is precisely constructed and configured in accordance with the teachings of our invention as described in detail hereinbelow, is disposed as shown in the nozzle block mounting groove 34. The nozzle blocks 36 are retained in the nozzle block mounting groove 34 by welding of the respective nozzle block inner shroud segments to the relevant abutting surfaces of the upper and lower hub halves 24 and 26, and by welding of the respective nozzle block outer shroud segments to the relevant abutting surfaces of the upper and lower nozzle block retaining ring halves 30 and 32, both in the manner described in detail hereinbelow. This nozzle block welding results in the formation of unitary upper and lower diaphragm half assemblies as should be obvious.

The upper and lower diaphragm half assemblies are disposed as shown in abutment along a common diametric plane or split 38 (which is horizontal in FIG. 1), and are maintained in longitudinally aligned, readily separable relationship with each other by a key 40 on the respective upper retaining ring and hub halves 30 and 24 which extends into a keyway 42 in the respective lower retaining ring and hub halves 32 and 26 in the manner best seen in FIG. 2. Transverse alignment of the respective upper and lower diaphragm half assemblies is effected by specialized, interfitting transitional nozzle blocks 44 and 46 which lie immediately adjacent the common horizontal plane or split 38 and are configured and operative as described in detail hereinbelow with regard to FIGS. 9 through 12 and 17.

A turbine rotor shaft and packing bore 48 is formed as shown centrally of the hub 22 by aligned, generally semi-circular stepped cut-outs 50 and 52 in the respective upper and lower hub halves 24 and 26.

Locating means for precisely locating the diaphragm assembly in the turbine casing are indicated generally at 54 in FIG. 1 and comprise semi-circular access notches 56 and 58 which are formed as shown in FIG. 4 in the respective extremities of the upper retaining ring half 30 adjacent the common horizontal plane 38. Tapped, semi-bores 60 and 62 are formed as shown in FIG. 3 to extend into the respective extremities of the lower retaining ring half 32 in alignment with the access notches 56 and 58 whereby may be understood that locating screws taking the form, for example, of headless set screws, may be inserted through said notches to extend into said semi-bores, and into mating semi-bores (not shown) in the turbine casing to locate the diaphragm assembly 20 in the turbine casing.

A particularly significant and advantageous feature of the diaphragm assembly 20 of the invention, and one which is discussed in greater detail hereinbelow in the description of the construction and configuration of the respective nozzle blocks 36, is that the exit edges 64 of the nozzle blades 37 are all substantially radially disposed, as indicated by the broken away portions for some of the nozzle blocks in FIG. 1; and it will be readily understood by those skilled in this art that this substantially radial disposition of the nozzle blade exit edges contributes significantly to the direction of the steam by the diaphragm assembly 20 at optimum entrance angles to the adjacent turbine rotor stage throughout the entire radial extent of the respective nozzle blades to thus maximize turbine efficiency.

2. Construction and Configuration of the Nozzle Blocks

All of the nozzle blocks 36, and the transitional nozzle blocks 44 and 46 (FIGS. 9–12) are constructed by standard investment casting techniques in the complete absence of machining prior to diaphragm assembly, with high spots, if any, being subsequently removed by stoning or belting. Referring now to FIGS. 5 and 7, it may be seen that each of the inner and outer shroud segments 39 and 41 of a nozzle block 36 has an integral, generally triangular tab as indicated at 100 and 102, respectively, which extends well beyond the exit edge 64 of the nozzle blade 37 in the direction of turbine rotation. Each of the shroud segment tabs comprises a generally radially extending locating surface 104 formed adjacent the exit edge 64 of the relevant nozzle blade, and terminates in a generally radially extending locating surface 106; and FIG. 7 which illustrates the upper shroud segments of a pair of adjacent nozzle blocks 36 makes clear that the same are precisely interfitted by the abutment of a locating surface 106 of one shroud segment tab against the locating surface 104 of an adjacent shroud segment tab, with the tab 102 of the first-mentioned shroud segment being coextensive with the nozzle blade 37 of the adjacent shroud segment as shown to precisely mate with said adjacent shroud segment and complete the shrouding of said adjacent nozzle blade. This precise shroud segment mating of course requires precise matching between the trailing surface of each shroud segment and the leading surface of the adjacent shroud segment as are respectively indicated at 110 and 108 for the adjacent upper shroud segments 41 as depicted in FIG. 7.

In addition, precise fitting of the respective nozzle blocks 36 in the generally V-shaped nozzle block mounting groove 34 will require precise matching as to slope of the respective outer surfaces 112 and 114 of the upper and lower shroud segments 39 and 41, and the outer surfaces of the tabs 100 and 102 with the corresponding surfaces of said mounting groove as is shown in FIG. 6. It may be understood for example, respective negative and positive slopes of approximately 15° relative to the longitudinal axis of the diaphragm assembly 20 may be provided for the outer surfaces 114 and 112 of upper and lower shroud segments 39 and 41 and also for the outer surfaces of the associated tabs 100 and 102 thereon.

Each of the nozzle blocks 36 is investment cast so that the exit edge 64 of the included nozzle blade 37 is substantially radial when the block is inserted in the diaphragm assembly 20, and so that the entrance edge 116 of the included nozzle blade 37 is positioned in such manner that the entrance edge radius Re has a constantly uniform positive relationship with regard to the exit edge 64 of the adjacent nozzle blade as illustrated in FIG. 8. This results in a nozzle blade section with a chord which increases from the I.D.S. to the O.D.S. in accordance with the increase in L. Thus, a constantly uniform positive throat throughout the full height of the nozzle blade passage 118 which extends between adjacent nozzle blades 37 is provided, and it will be readily apparent to those skilled in this art that such is not possible through use of extruded nozzle blades wherein the blade chord is, of course, fixed throughout the extent of the blade and wherein radial, rather than parallel to radial, disposition of the nozzle blade exit edges cannot as a practical matter be achieved. As a result, it is believed made clear that direction of the steam at optimum entrance angles to an adjacent rotor stage throughout the full height of the nozzle blades as is provided by the nozzle blocks 36 of our invention would be impossible through use of the extruded nozzle blades of the prior art. Although the configuration of the nozzle blocks 36 of our invention could possibly be duplicated by machining, it is belived clear to those skilled in this art that the extreme difficulty and expense of such procedure would be so prohibitive as to render the same impractical from a commercial standpoint.

The investment casting as described of the nozzle blocks 36 to include only a single nozzle blade 37 further provides for the advantage that the investment casting tolerances are more readily held to thereby completely eliminate the need for nozzle block machining prior to diaphragm assembly construction, and permit extremely precise control of pitch diameter and individual nozzle blade to nozzle blade pitch.

Referring now to FIGS. 9 and 10 for the description of the transitional nozzle block 44 (FIG. 1) which is utilized at the split 38, the same may readily be seen to differ from the nozzle blocks 37 of FIGS. 5 through 8 only in that the shroud segment tabs 100 and 102 are removed therefrom as indicated in phantom in FIGS. 9 and 10 with the result that the nozzle block 44 terminates substantially at the exit edge of the included nozzle blade.

FIGS. 11 and 12 illustrate the transitional nozzle block 46 which mates with the transitional nozzle block 44 in each instance at the split 38, and nozzle block 46 may readily be seen to differ from the nozzle blocks 36 only in that additional shroud segment tab portions 120, which are of course substantially identical to the shroud segment tabs removed from the transitional nozzle block 44, are integrally included in the transitional nozzle block 46 to extend as shown from the shroud segment surfaces 108 adjacent the leading face of the nozzle blade 37 and provide additional locating surfaces 121. Thus may be readily understood that transitional nozzle block 44 is precisely matable with transitional nozzle block 46.

3. Method of Construction of the Diaphragm Assembly

The construction of the diaphragm assembly 20 in accordance with the teachings of our invention is commenced by the selection of a flat cylindrical plate as indicated generally at 70 in FIGS. 13 and 14 of appropriate diameter and thickness, each of which will, of course, vary in accordance with the particular steam flow requirements and dimensions of the turbine in which the diaphragm assembly is to be utilized. A stepped, generally straight sided arcuate groove—which becomes the stepped, generally slope sided nozzle block mounting groove as indicated generally at 34 upon further machining of the plate 70 as described in detail hereinbelow—is machined in the steam entrance face 72 of the plate 70, and this is followed by the cutting in half of the plate 70 along a common horizontal plane or split 38 to form the respective upper and lower hub halves 24 and 26. Thereafter, the respective halves are separated, the split surfaces thereof appropriately finished, and the steam entrance and exit faces 72 and 74 are faced to a uniform surface. The inlet face 72 is then stamped, and the key 40 and keyway 42 respectively machined in the split surfaces of the upper hub half 24 and the lower hub half 26, and it is important that the spatial relationship of the keyway 42 to the inlet face 72 as depicted in FIG. 15 be provided.

Formation as described of the key 40 and keyway 42 is followed by assembly of the hub halves 24 and 26 in obvious manner, and the tack welding thereof at the outer diameter of and along the split on the exit face 74, only, as indicated at 76 in FIG. 14, to once again form a structurally integral plate 70.

A central aperture 78 is then drilled in the plate 70 for fixturing of the same, whereupon the respective side surfaces 80, 82, 84 and 86 of the generally V-shaped nozzle block mounting groove 34 are machined to provide the illustrated, respective slopes thereof. More specifically, it may be understood that nozzle block mounting groove side surfaces 80 and 82 are machined to slopes which are compatable with the respective slopes of the shroud segments 41 and 39 of nozzle blocks 36 which are to be disposed therein as described in detail hereinbelow; while nozzle block mounting groove side surfaces 84 and 86 are machined to slopes which will provide appropriate J-grooves or annular spaces 88 and 90 for welding of the nozzle blocks to the upper and lower hub halves, again as described in detail hereinbelow. A typical construction of the diaphragm assembly 20 of our invention will, for example, call for respective, approximately 15° positive and negative slopes of groove sides 80 and 82 relative to the longitudinal axis of plate 70, and for respective, approximately 30° positive and negative slopes of groove sides 84 and 86 relative to said longitudinal axis.

Machining as described of the nozzle block mounting groove 34 is followed by appropriate degreasing of the plate 70; and it is believed clear that an annular web 92 which closes off the prospective nozzle flow passages remains at this stage in the construction of the diaphragm assembly 20 of the invention to retain in perfect relative position what will become the upper and lower retaining ring halves 30 and 32 of FIG. 1 upon removal of said web.

Figure 17:
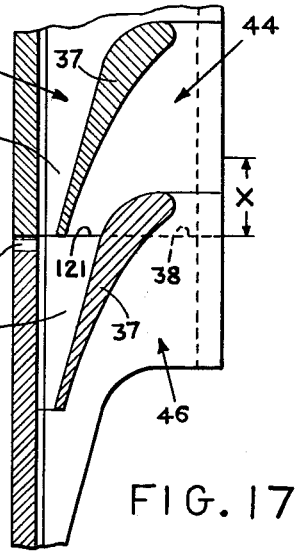
FIG. 17 is a cross-sectional view taken along line 17—17 in FIG. 16.

The thusly machined plate 70 is then horizontally disposed in an appropriate fixture and the arcuate array of the respective nozzle blocks 36, and the transitional nozzle blocks 44 and 46, disposed in the nozzle block mounting groove to fit precisely therein in precisely block-to-block mated fashion. Precise positioning of the transitional nozzle block 46 to traverse the split 38, and thus insure precise circumferential positioning of all of the nozzle blocks, is effected as illustrated in FIGS. 16 and 17 for the right hand side of plate 70 by the insertion of a locating dowel pin 122 through an appropriate bore which is drilled through the web 92 in the back face 74 (FIG. 14) of plate 70 to abut the additional shroud segment tab 120 of the transitional nozzle block 46. Thus the transitional nozzle block 46 will act as a transverse locating dowel to precisely center the respective diaphragm half assemblies and insure precise alignment at the rotor shaft and packing bore 48 (FIG. 1) upon joinder of the diaphragm half assemblies at split 38. Sufficient strength for this locating function of transitional nozzle block 46 is insured by utilization of only the heavy leading portion of the nozzle block to traverse the split 38.

Figure 18:
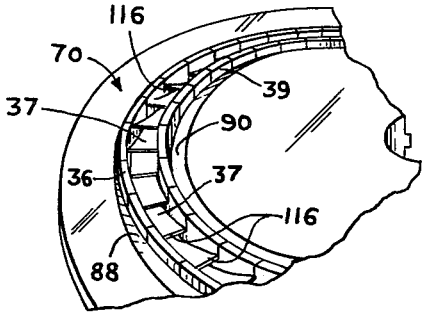
FIGS. 18 through 21 are respectively perspective views illustrating the positioning and bonding of the nozzle blocks in the diaphragm assembly.
Figure 19:
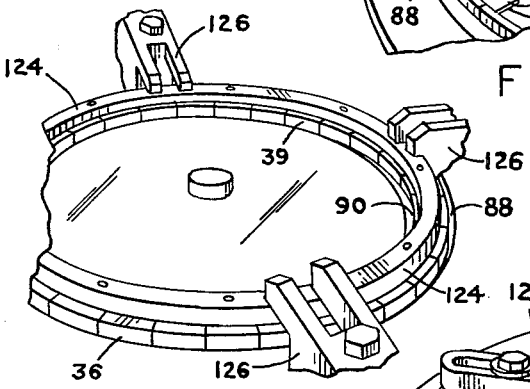

With all of the nozzle blocks positioned in the nozzle block mounting groove 34 as illustrated in FIG. 18, the same are precisely and firmly clamped and maintained in position by use of a full 360° fixture 124 and clamps 126 which, as illustrated in FIG. 19 force the fixture to bear firmly against the respective entrance edges 116 of the nozzle blades 37 to force the respective sloped outer surfaces 112 and 114 (FIG. 6) of the upper and lower shroud segments of the nozzle blocks into precise mating with the correspondingly sloped surfaces 80 and 82 (FIG. 14) of the nozzle block mounting groove 34.

Figure 20:
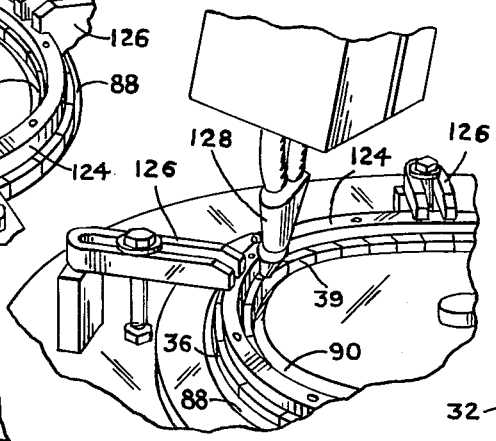
Figure 21:
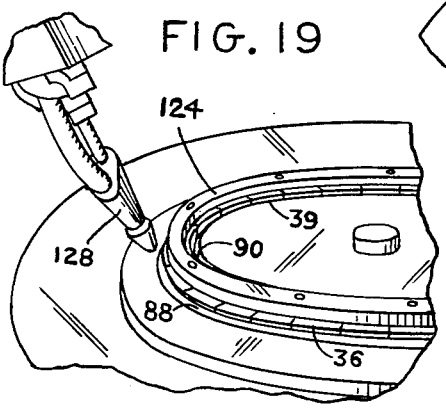

With the nozzle blocks clamped as described in the nozzle block mounting groove 34, submerged arc welding means 128 are utilized as indicated in FIG. 20 to arc weld the respective inner shroud segments 39 of the nozzle blocks to the inner nozzle block mounting groove surface 82. Following this, the clamping means 126 are removed and the submerged arc welding means 128 utilized as illustrated in FIG. 21 to arc weld the respective outer shroud segments 41 of the nozzle blocks to the outer nozzle block mounting groove surface 80. This submerged arc welding is commenced and terminated a specified distance X (FIG. 17) above and below the horizontal split 38 in each instance to insure that the respective diaphragm halves are not arc welded together.

Completion of the submerged arc welding as described is followed by stress relief of the resultant plate and nozzle block assembly to remove any stresses therefrom which may have been introduced by the welding and/or prior plate machining steps.

Figure 22:
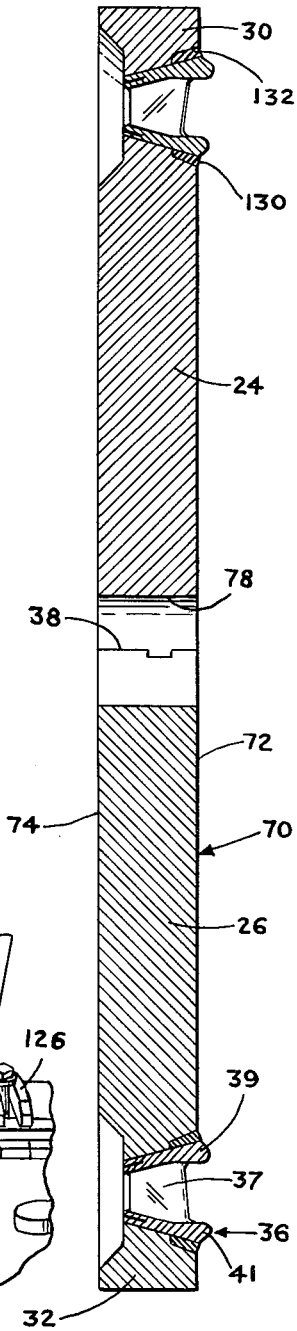
FIG. 22 is a vertical cross-sectional view taken through the diaphragm assembly to illustrate an intermediate machining step in the construction thereof.

Machining of the exit face 74 of the plate 70 to the configuration depicted in FIG. 22 is then accomplished, and it is noted that this machining is carried out by coming as close as possible to the respective exit faces of the nozzle blocks 36 with minimum, if any, cutting thereof. This machining is, of course, effective to remove the web 92 (FIG. 14) to thus open the respective nozzle block flow passages and result in the formation of the retaining ring halves 30 and 32 and the hub halves 24 and 26.

The now almost complete diaphragm assembly is then degreased, and this is followed by electron beam welding in the generally J-shaped grooves 88 and 90 to form the weld beads 130 and 132 to complete the particularly firm bonding of the respective nozzle blocks to the respective hub and retaining ring halves and, in each instance, the particularly firm bonding of each of the nozzle blocks to the nozzle blocks which are disposed adjacent thereto to either side thereof. Again, this welding is commenced and terminated in each instance a predetermined distance above and below the split 38 to insure that the respective diaphragm half assemblies are not electron beam welded together.

Final machining of the diaphragm assembly is then carried out to provide the finished configuration thereof depicted in FIGS. 1 and 2, and it is believed clear that this final machining will include the enlargement of the fixturing bore 78 (FIG. 13) to form the rotor shaft and packing bore 48 of FIG. 1. Severance of the tack welds 76 (FIG. 14) at the exit face 74 of the plate 70 is then effective to enable separation of the respective diaphragm half assemblies, and it may be understood that further stress relief is not required after final machining.

By the above is believed made clear that the teachings of our invention result in the provision of a particularly strong and structurally stable diaphragm assembly which is well-suited to long periods of satisfactory use despite the extreme temperature and vibrational stresses to which the same will, or course, be subjected.

Various changes may of course be made in the disclosed structures and methods of construction of our invention without departing from the spirit and scope thereof as defined in the appended claims.

We claim:

1. A method for making a turbine diaphragm assembly wherein the cylindrical plate portion of the diaphragm assembly becomes the fixture for making the same which comprises the steps of:

a. forming and shaping in the front face of the cylindrical plate of the diaphragm assembly an arcuate generally V-shaped nozzle block mounting groove so that the respective inner and outer side surfaces of the arcuate nozzle block mounting groove have a predetermined slope relative the longitudinal axis of the cylindrical plate, b. investement casting a plurality of substantially identically shaped and sized integral mounting blocks each having a nozzle blade of predetermined profile extending between an inner shroud segment and an outer shroud segment respectively formed to interfit with the inner shroud segment and outer shroud segment of any other of the nozzle blocks, and each of said nozzle blocks having an inner and outer surface which slopes in corresponding degree to the slope of the side surfaces of the arcuate nozzle blade mounting grooves, c. disposing an arcuate array of said nozzle blocks in said groove in interfitted side by side relationship so that in assembled position the respective exit edges of the nozzle blades are substantially radially disposed relative to the longitudinal axis of the cylindrical plate, d. bonding said inner surface and outer surface of the respective inner shroud segment and outer shroud segment of each of said nozzle blocks to the mating and matching slope of the respective inner and outer side surfaces of said nozzle block mounting groove, e. removing material from the back face of said cylindrical plate in alignment with said nozzle block mounting groove to open a plurality of fluid flow passages through said cylindrical plate as defined by the nozzle blades on adjacent nozzle blocks, f. electron beam welding the entrance end of said nozzle blocks to the front face of the cylindrical plate, and g. finish machining the cylindrical plate and nozzle blocks to provide the completed diaphragm assembly.

2. In the method for making a turbine diaphragm assembly as claimed in claim 1, the preliminary steps before forming and shaping the arcuate V-shaped nozzle block mounting groove of:

a. dividing said cylindrical plate along a generally diametric plane to split said cylindrical plate into two substantially equal half sections, b. machining the joint formed between the half sections of the divided cylindrical plate, c. joining said half sections at the machined joint and temporarily bonding said half sections together until the nozzle blocks are disposed in the nozzle block mounting groove and are bonded in assembled position, and d. severing said temporary bond during the finished machining to complete the diaphragm assembly.

3. In the method of making a turbine diaphragm assembly as claimed in claim 1 wherein investment casting of said plurality of nozzle blocks includes the step of, a. forming a single nozzle blade on each of said nozzle blocks having a varying cord which increases from the inner shroud segment to the outer shroud segment, b. the flow passages formed by the nozzle blades of assembled adjacent nozzle blocks defining fluid flow passages therebetween each having a constantly uniform positive throat throughout substantially the full radial extent of the same whereby motive fluid passing through said diaphragm assembly will be delivered at the optimum entrance angles to an adjacent rotor stage to maximize turbine efficiency.

4. In a method of making a turbine diaphragm assembly as claimed in claim 1 including the steps of, a. placing a ring of appropriate diameter in firm surface contact with the respective entrance edges of the nozzle blades after the nozzle blocks are in assembled position in said nozzle block mounting groove to force said nozzle blocks into firm surface to surface contact with the inner and outer side surfaces of said nozzle block mounting groove, and b. clamping said ring to said cylindrical plate.

5. In a method of making a turbine diaphragm assembly as claimed in claim 2, the steps of, a. providing in said plurality of nozzle blocks at least two transitional nozzle blocks disposed for interfitting engagement with each other, b. disposing one of said transitional nozzle blocks at each side of said joint between the half sections of said cylindrical plate so as to extend in part across the same, and c. said transitional nozzle blocks disposed to fixedly align said half sections in the transverse direction.

* * * * *